US007682007B2

(12) United States Patent
Sasaki

(10) Patent No.: US 7,682,007 B2
(45) Date of Patent: Mar. 23, 2010

(54) INK CARTRIDGES

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 413 days.

(21) Appl. No.: 11/672,865

(22) Filed: Feb. 8, 2007

(65) Prior Publication Data

US 2007/0229616 A1 Oct. 4, 2007

Related U.S. Application Data

(63) Continuation of application No. 11/536,665, filed on Sep. 29, 2006, now Pat. No. 7,188,939.

(60) Provisional application No. 60/826,254, filed on Sep. 20, 2006.

(30) Foreign Application Priority Data

Mar. 31, 2006 (JP) ..... 2006-097842

(51) Int. Cl.
*B41J 2/175* (2006.01)

(52) U.S. Cl. ..... 347/86

(58) Field of Classification Search ..... 347/6, 347/7, 84–86; 137/558; 73/209 R, 305, 73/313, 320, 322.5
See application file for complete search history.

(56) References Cited

U.S. PATENT DOCUMENTS

| | | | | |
|---|---|---|---|---|
| 2,370,099 | A * | 2/1945 | Werder | 73/313 |
| 6,899,418 | B2 | 5/2005 | Sasaki et al. | |
| 7,188,939 | B1 * | 3/2007 | Sasaki | 347/86 |
| 2005/0068389 | A1 | 3/2005 | Katayama et al. | |

FOREIGN PATENT DOCUMENTS

JP 8281966 A 10/1996

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

An ink cartridge includes a movable member which includes a sliding member and a float portion. The sliding member includes a signal blocking portion, and the signal blocking portion is configured to move in a first direction from a first position within a translucent portion to a second position based on the amount of ink within the ink chamber. Moreover, the float portion is operationally coupled to the sliding member, and the float portion is disposed within the ink chamber. The float portion is configured to move independent of the first portion in a second direction from a third position to a fourth position based on the amount of ink within the ink chamber. For example, the second direction may be substantially perpendicular to the first direction or may be slanted with respect to the first direction.

11 Claims, 6 Drawing Sheets

INK CARTRIDGES

CROSS-REFERENCE TO RELATED APPLICATIONS

The present application is a continuation application from U.S. patent application Ser. No. 11/536,665, which was filed on Sep. 29, 2006, and claims priority from Japanese Patent Application No. JP-2006-097842, which was filed on Mar. 31, 2006, U.S. Provisional Patent Application No. 60/826,254, which was filed on Sep. 20, 2006, and U.S. patent application Ser. No. 11/536,665, the disclosures of which are incorporated herein by reference in their entirety.

BACKGROUND OF THE INVENTION

1. Field of the Invention

The present invention relates generally to ink cartridges. In particular, the present invention is directed towards ink cartridges which may be used in combination with printers.

2. Description of Related Art

Ink cartridges which are configured to be used in combination with ink jet printers are known in the art. In such known ink cartridges it is possible to detect when the amount of ink in the ink cartridge is relatively low. For example, one known ink cartridge comprises a movable member which is pivotally supported inside an ink reservoir. The movable member has a blocking portion at one end and a float portion at the other end. When the ink chamber is filled with ink, the rotation of the movable member due to the rising of the float portion in the vertical direction is restricted by a stopper, such that the blocking portion is positioned at the blocking position, where the blocking portion blocks light emitted from a sensor provided in a printer. When the surface level of the ink is lowered, the position of the float in the vertical direction also is lowered, and the position of the blocking portion in the vertical direction rises, thereby moving the blocking portion from the blocking position to a non-blocking position. Thus, the printer then may determine that the ink cartridge includes substantially no ink, and the ink cartridge needs to be replaced.

SUMMARY OF THE INVENTION

A need has arisen for ink cartridges which overcome shortcomings of the related art. A technical advantage of the present invention is that a printer may determine that the ink cartridge includes substantially no ink without increasing the width of the ink cartridge.

According to an embodiment of the present invention, an ink cartridge comprises an ink chamber comprising a wall having a first end and a second end opposite the first end, and a translucent portion positioned at the wall. The translucent portion is configured to be in fluid communication with the ink chamber, and the translucent portion has an inner space formed therein. The ink cartridge also comprises a movable member comprising a sliding member and a float portion. The sliding member comprises a signal blocking portion, and the signal blocking portion is configured to move in a first direction from a first position within the translucent portion to a second position based on the amount of ink within the ink chamber. The float portion is operationally coupled to the sliding member, and the float portion is disposed within the ink chamber. Moreover, the float portion is configured to move independent of the sliding member in a second direction from a third position to a fourth position based on the amount of ink within the ink chamber. For example, the second direction may be substantially perpendicular to the first direction or may be slanted with respect to the first direction.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention and their features and technical advantages may be understood by referring to FIGS. 1-6, like numerals being used for like corresponding portions in the various drawings.

Figure 1:
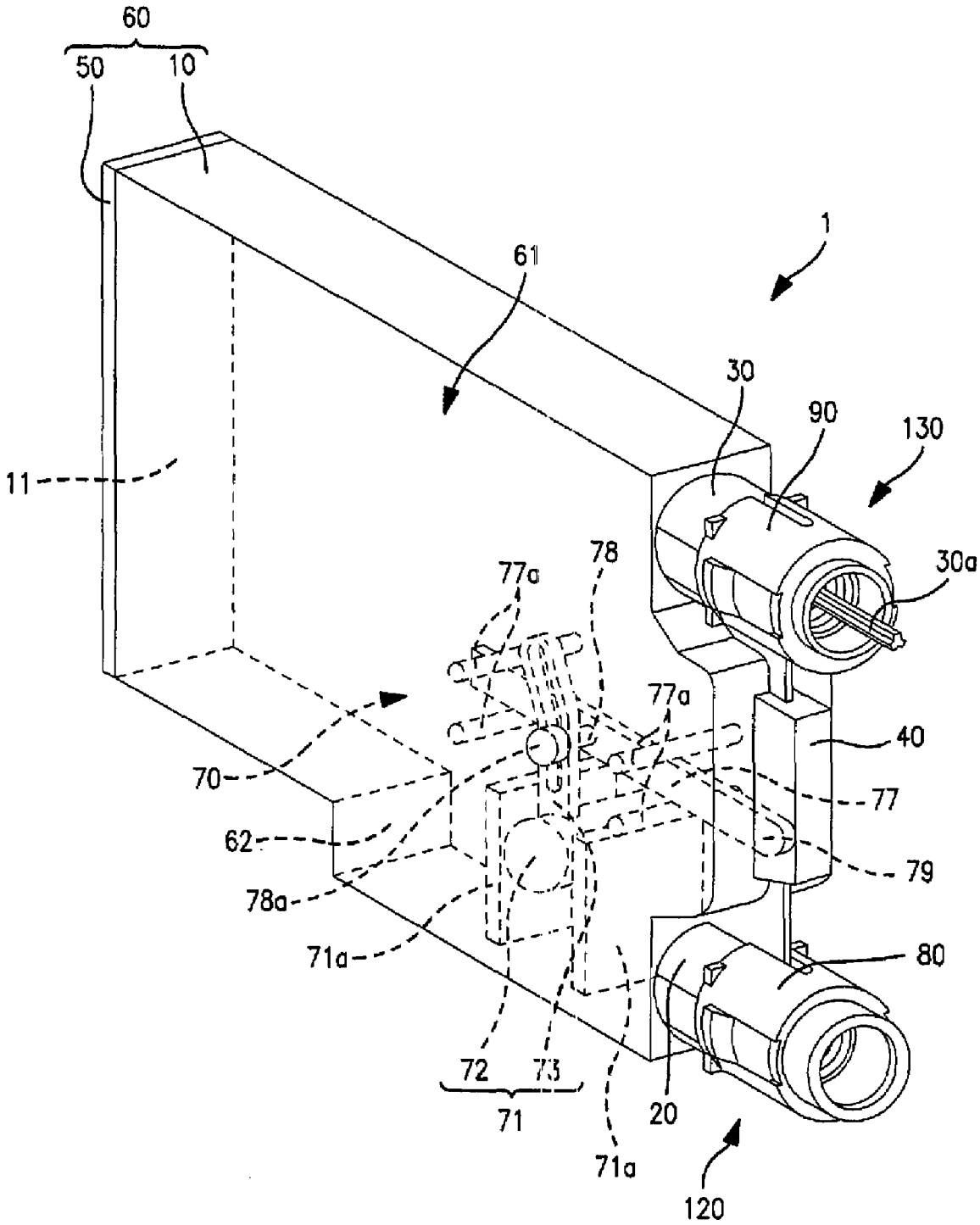
FIG. 1 a perspective view of an ink cartridge, according to an embodiment of the present invention.

Referring to FIG. 1, an ink cartridge 1 may comprise a main body 10 which may have a shallow box shape and may have a bottom with a main opening 11, and a lid 50 which may be configured to close main opening 11 of main body 10. Main body 10 and lid 50 may form a case 60, e.g., a case having a truncated rectangular shape. Ink cartridge 1 also may comprise an ink chamber 61 which may be positioned within case 60 and may store ink therein, and a movable member 70 which may be positioned within ink chamber 61. Main body 10 and lid 50 may comprise a resin material, e.g., polypropylene, and may be manufactured using an injection molding. Moreover, ink cartridge 1 may comprise an ink supply portion 120 for supplying ink from an interior of ink chamber 61 to an exterior of ink chamber 61, and an air intake portion 130 for drawing air into ink chamber 61. Ink supply portion 120 and air intake portion 130 may be formed on the same side surface.

An ink outlet 20 may be formed on the bottom side of wall which faces main opening 11, which may be connected to ink chamber 61, and an air connection path 30 may be formed on the top side, which may be connected to ink chamber 61. Ink outlet 20 and air connection path 30 each may have a tube shape which extends along the longitudinal direction, and a portion of an ink supply mechanism 80 may be inserted within ink outlet 20. Moreover, a portion of an air intake mechanism 90 may be inserted within air connection path 30.

Ink supply mechanism 80 may be configured to close the ink path when ink cartridge 1 is not installed in printer 1000, and to open the ink path when ink cartridge 1 is installed in printer 1000. Therefore, ink supply portion 120 may supply ink from ink chamber 61 to printer 1000 when ink cartridge 1 is installed in printer 1000.

Air intake mechanism 90 may have a valve opening portion 30*a* which protrudes towards the outside of air connection path 30 when a portion of it is enclosed within air connection portion 30. Air intake mechanism 90 may be configured to close air connection path 30 when ink cartridge 1 is not installed in printer 1000, and to open air connection path 30 when ink cartridge 1 is installed in printer 1000. Valve opening portion 30*a* may contact installation surface 1013 of printer 1000, and air connection path 30 may be opened. Therefore, air intake portion 130 may be connected with the inside of ink chamber 61 when ink cartridge 1 is installed in printer 1000.

Figure 5A:
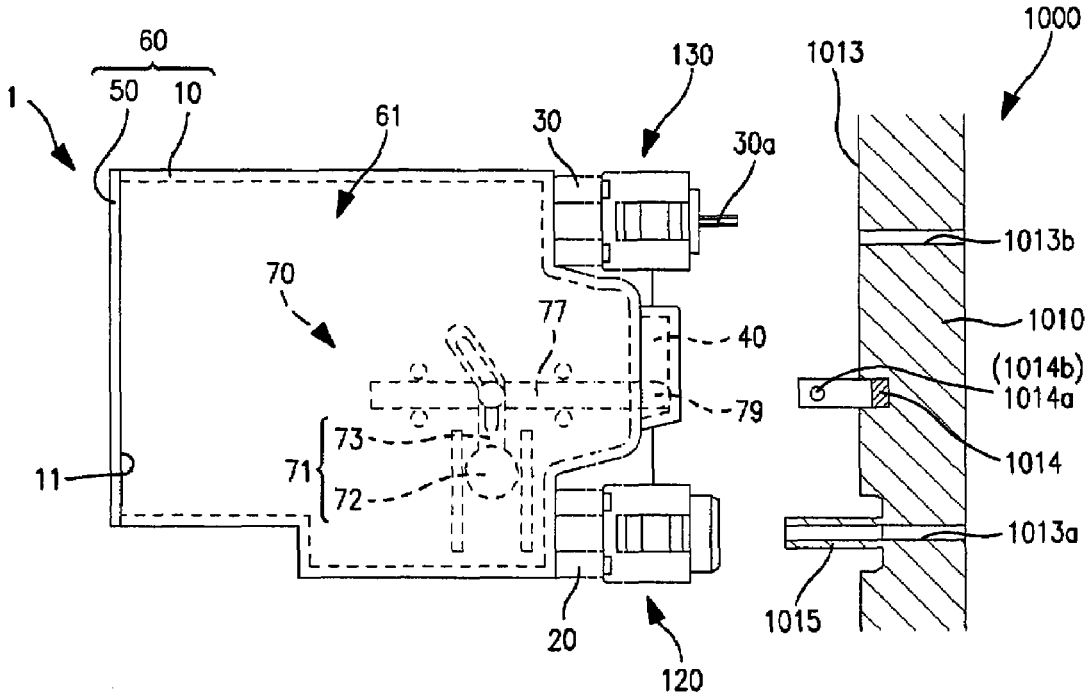
FIGS. 5(*a*) and 5(*b*) are diagrams depicting a method installing the ink cartridge of FIG. 1 into a printer.
Figure 5B:
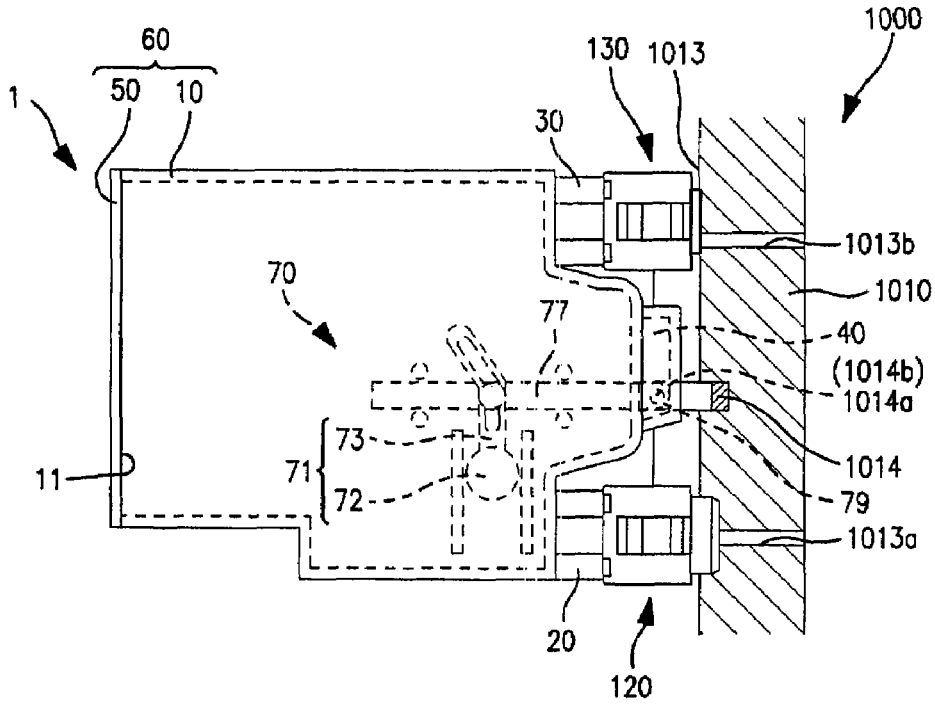

Moreover, a translucent portion 40 may protrude towards the outside of ink cartridge 1 between ink outlet 20 and air connection path 30, and translucent portion 40 may have an inner spaced formed therein. The length along the width direction of translucent portion 40 may be less than the length in the width direction of ink cartridge 1. Referring to FIGS. 5(*a*) and 5(*b*), translucent portion 40 may be positioned between a light emitting portion 1014*a* and a light receiving portion 1014*b* of a sensor 1014 of printer 1000 when ink cartridge 1 is installed in printer 1000.

Figure 2:
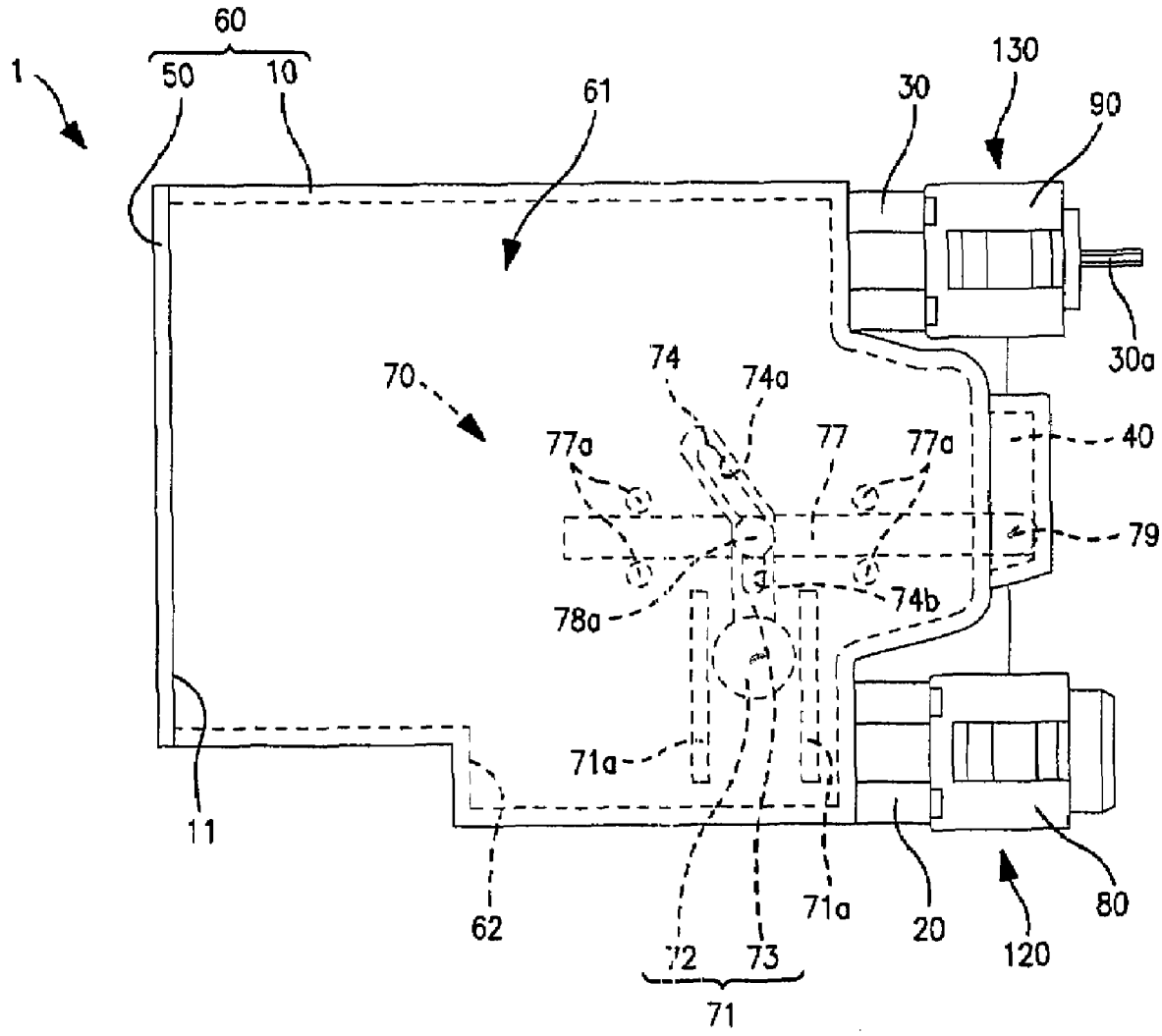
FIG. 2 is side view of the ink cartridge of FIG. 1.
Figure 3A:
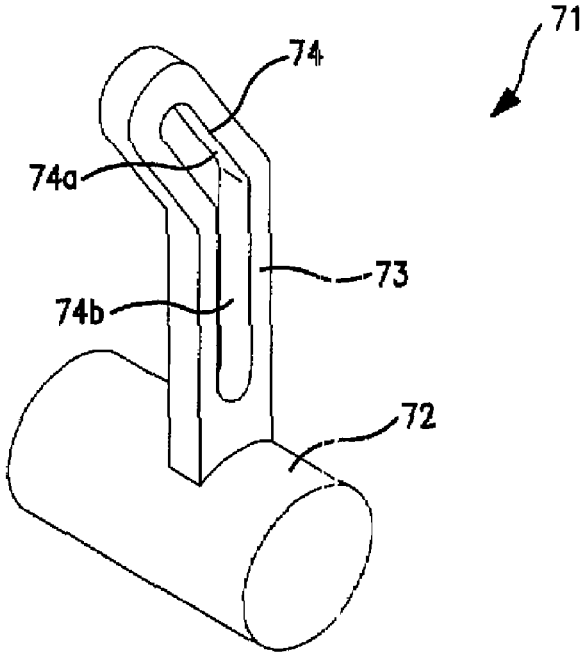
FIGS. 3(*a*) and 3(*b*) are diagrams of an guide component and a slide member, respectively, of the ink cartridge of FIG. 1.
Figure 3B:
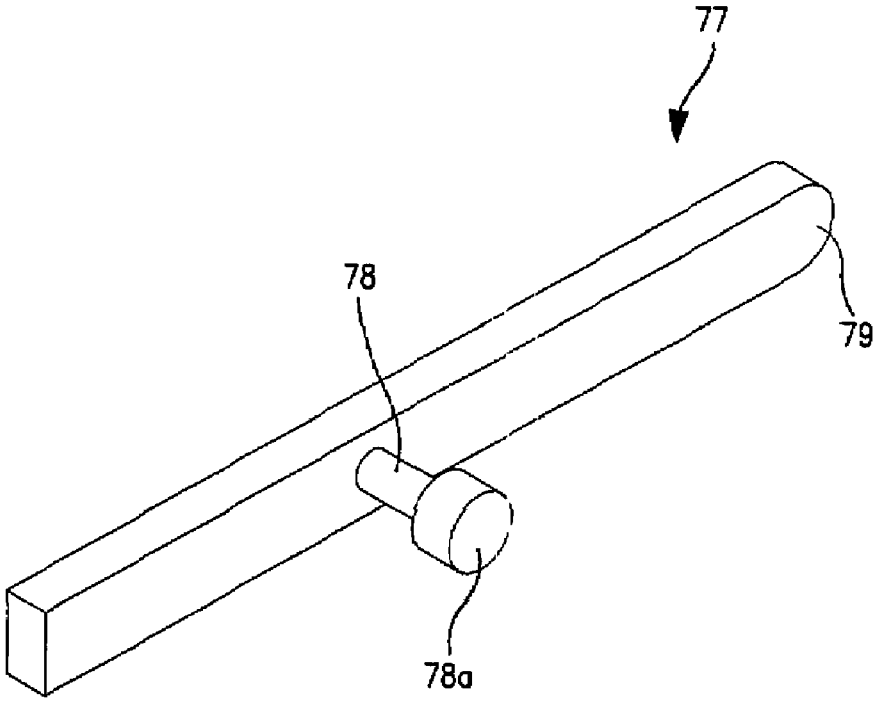

Referring to FIGS. 1-3(*b*), a guide component 71 may comprise a resin, e.g., a styrene resin, having a specific gravity which is less than the specific gravity of ink. Guide component 71 may comprise a round pillar-shaped float portion 72 which extends along the width direction of ink cartridge 1, and an extender portion 73 which extends from float portion 72 and further extends at an angle away from translucent portion 40. The volume of float portion 72 may be substantially greater than the volume of extender portion 73. Moreover, the volume ratio of float portion 72 in guide component 71 may be selected, such that when float portion 72 is positioned within the ink, the buoyancy generated in guide component 71 is greater than gravity, and such that when one portion of float portion 72 is exposed from the ink, the buoyancy generated in guide component 71 is about equal to gravity.

Referring to FIG. 3(*a*), an opening 74, e.g., a guide path, may be formed within extender portion 73, and opening 74 may have substantially the same shape as the outer shape of extender portion 73. A sloped surface 74*a* and a vertical surface 74*b* may be formed on one side of the pair of opposing surfaces which defines opening 74 and extend along the extension direction of opening 74. Each of sloped surface 74*a* and vertical surface 74*b* may be a surface contributing to moving slide member 77. For example, float portion 72 may be operationally coupled to slide member 77 via extender portion 73.

Referring to FIGS. 1 and 2, a control component 71*a* may comprise a pair of plate-shaped components which extend in parallel along the vertical direction and are spaced in the longitudinal direction of case 60. The pair of plate-shaped components may be arranged, such that they connect the space between the pair of side walls which have the maximum area of case 60. Further, float portion 72 may be positioned between the pair of control components 71*a*. For example, the spacing of the pair of control components 71*a* may be slightly wider than the diameter of float portion 72, and therefore, float portion 72 may be smoothly displaced in vertical direction between the pair of control components 71*a*. Referring to FIG. 2, because there may be a space formed between the lower edge portion of control component 71*a* and case 60, ink within ink chamber 61 may smoothly move towards ink supply portion 120 through the space.

Slide member 77 may comprise a rod-shaped component which extends in the longitudinal direction. Slide member 77 may have light-blocking properties, and may be supported, such that it may move along the extension direction at a predetermined height level. A pin 78 may extend from the central portion in longitudinal direction of slide member 77, which may be inserted into opening 74. A stopper 78*a* may be formed at an edge portion of pin 78, and stopper 78*a* may be wider than opening 74, such that pin 78 does not fall out of opening 74.

Moreover, slide member 77 may comprise a blocking portion 79 which may be selectively positioned within the inner space of translucent portion 40, and the presence of blocking portion 79 within the inner space of translucent portion 40 may be detected by sensor a 1014 of printer 1000. For example, when pin 78 is in contact with vertical surface 74*b* within opening 74, blocking portion 79 may be positioned within translucent portion 40, and when pin 78 is in contact with the edge portion of sloped surface 74*a* within opening 74, blocking portion 79 may be positioned outside of the inner space of translucent portion 40.

Slide member 77 may comprise a plurality, e.g., four, rod-shaped member that connect the pair of side walls having the maximum area of case 60. The spacing of the pair of support members 77*a* which are adjacent in vertical direction may be slightly larger than the length in vertical direction of slide member 77, and therefore, slide member 77 may smoothly slide between the pair of support members 77*a*.

Figure 4A:
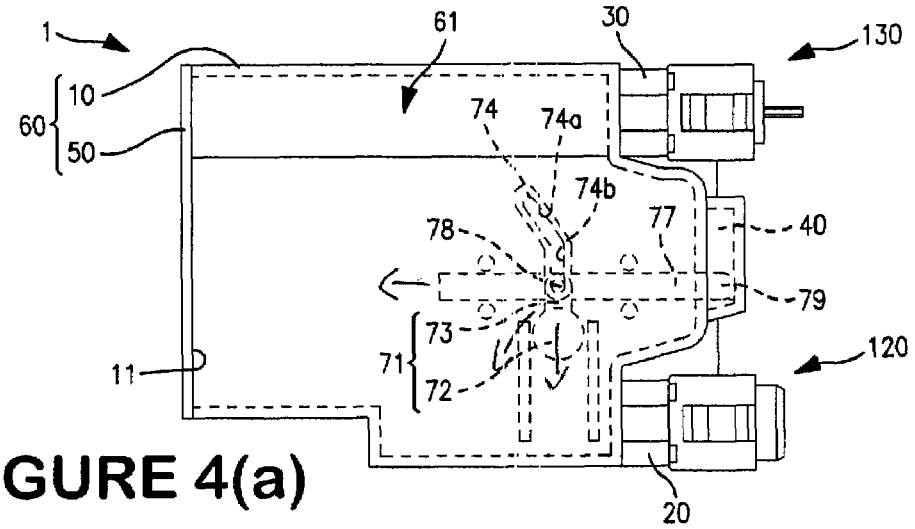
FIGS. 4(*a*)-4(*c*) are diagrams depicting a method of detecting an amount of ink within an ink chamber of the ink cartridge of FIG. 1.
Figure 4B:
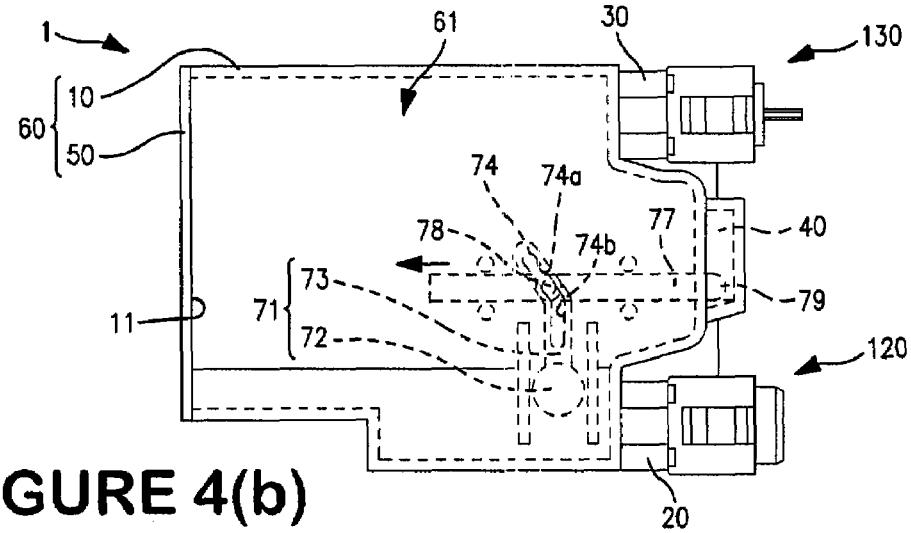
Figure 4C:
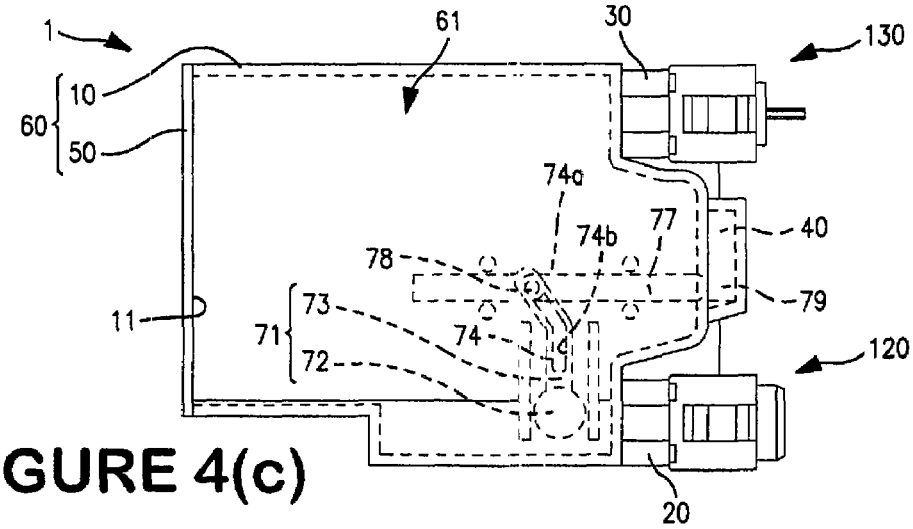

Referring to FIG. 4(*a*), when the ink stored within ink chamber 61 is sufficient, the buoyancy generated in guide component 71 is greater than gravity, such that guide component 71 receives a force that is directed upwards. As a result, pin 78 of slide member 77 contacts the edge portion of vertical surface 74*b*. Therefore, blocking portion 79 is positioned at within translucent portion 40. At this time, the space between light emitting portion 1014*a* and light receiving portion 1014*b* of sensor 1014 of printer 1000 is blocked by blocking portion 79, and a determination that there is ink remaining may be made by a control substrate (not shown) of printer 1000.

When the level of the ink within ink chamber 61 drops, and one portion of float portion 72 is exposed from the ink surface, the buoyancy generated in guide component 71 is about equal to gravity. When the ink level drops even further, guide component 71 is displaced downwards along with the reduction in the ink level. While guide component 71 falls from position shown in FIG. 4(*a*), pin 78 of slide member 77 contacts vertical surface 74*b* along the vertical direction. At this time, slide member 77 will not move, and blocking portion 79 will be positioned within translucent portion 40. Therefore, the space between light emitting portion 1014*a* and light receiving portion 1014*b* of sensor 1014 is blocked, and determination will be made by the control substrate in printer that there is still ink remaining.

Referring to FIG. 4(*b*), when the amount of ink remaining within ink chamber 61 is reduced, and guide component 71 has fallen to a position in which pin 78 of slide member 77 contacts sloped surface 74*a*, pin 78 is guided away from translucent portion 40 by sloped surface 74*a*, and slide member 77 slides to the opposite side to translucent portion 40, e.g., to a position outside of the inner space of translucent portion 40, independent of the movement of guide component 71, e.g., independent of the movement of float portion 72 of guide component 71. For example, slide member 77 may move in a direction which is substantially perpendicular to the direction of movement of float portion 72.

Then, referring to FIG. 4(*c*), when guide component 71 has fallen to a position in which pin 78 of slide member 77 contacts the edge portion of sloped surface 74*a*, blocking portion 79 is displaced outside the inner space of translucent portion 40. At this time, light may pass between light emitting portion 1014*a* and light receiving portion 1014*b* of sensor

1014, and determination may be made by the control substrate that there is substantially no ink remaining within ink chamber 61.

Referring to FIG. 5(*a*), sensor 1014 may be formed on an attachment portion 1010 into which ink cartridge 1 may be attached in printer 1000. Sensor 1014 may have a truncated U-shape, and one edge portion of the opened U-shape may comprise light emitting portion 1014*a*, and the other edge portion may comprise light receiving portion 1014*b*. Light emitting portion 1014*a* and light receiving portion 1014*b* may protrude from an attachment surface 1013. In operation, sensor 1014 may not emit a signal to the control substrate when the light emitted from light emitting portion 1014*a* is received by light receiving portion 1014*b*, and sensor 1014 may emit a signal to the control substrate when the light emitted from light emitting portion 1014*a* is blocked by blocking portion 79, or vice versa.

Moreover, an ink extraction pipe 1015 may protrude on the side opposing ink supply portion 120, and the attachment surface 1013 may be a flat surface. An ink path 1013*a* may be connected to ink extraction pipe 1015, and ink may be supplied to a discharge outlet (not shown) via ink path 1013*a*. An air intake path 1013*b* may be formed in attachment surface 1013, and air may be drawn into ink chamber 61 via air intake path 1013*b*.

Referring to FIG. 5(*b*), when ink cartridge 1 is installed in attachment portion 1010, air may be drawn in as valve opening portion 30*a* of air intake portion 130 comes into contact with attachment surface 1013, and detection portion 40 becomes positioned between light emitting portion 1014*a* and light receiving portion 1014*b*, which allows for the detection of the amount of ink remaining within ink chamber 61.

Figure 6:
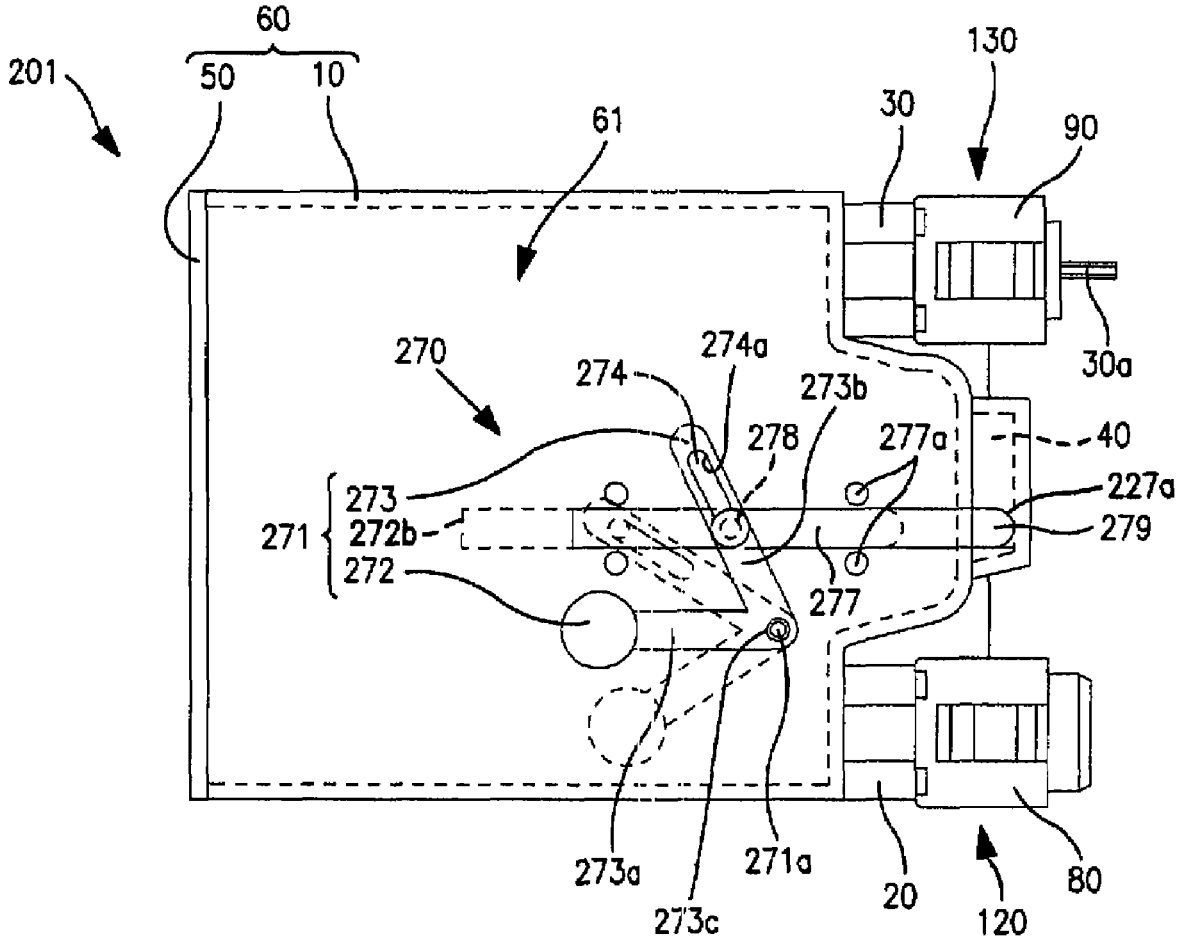
FIG. 6 is a diagram of an ink cartridge, according to another embodiment of the present invention.

Referring to FIG. 6, in another embodiment of the present invention, an ink cartridge 201 is depicted. Ink cartridge 1 is substantially similar to ink cartridge 1, except that movable member 70 of ink cartridge 1 is replaced by movable member 270. Therefore, only the differences between ink cartridge 270 and ink cartridge 1 are discussed with respect to ink cartridge 270.

In this embodiment of the present invention, movable member 270 may comprise an guide component 271, a control component 271*a* to control the displacement of guide component 271, a slide member 277, and a support member 277*a* to support slide member 277.

Guide component 271 may comprise a resin material, e.g., a styrene resin, which has a specific gravity which is less than the specific gravity of ink. Guide component 271 may comprise an extender portion 273 having a bent shape and which opens in a direction away from translucent portion 40. Extender portion 273 may comprise a first arm 273*a* which extends in a first direction, and a second arm 273*b* which extends in a second direction and which is connected to the edge portion of first arm 273*a*, such that an acute angle is formed between first arm 273*a* and second arm 273*b*. Guide component 271 also may comprise a round, pillar-shaped float portion 272 which is connected to an end of first arm 273*a*.

A through-hole 273*c* may be connected to control component 271*a* which may be located within the bent portion of extender portion 273. Control component 271*a* may comprise a rod-shaped member which connects the pair of side walls having the maximum area of case 60, and which extend in the horizontal direction. The diameter of control component 271 may be less than the diameter of through-hole 273*c*. Therefore, guide component 271 may smoothly rotate about the bent portion of extender portion 273.

The volume of float portion 272 may be larger than the volume of extender portion 273. Moreover, the volume ratio between extender portion 273 and float portion 272 may be selected, such that when float portion 272 is positioned within the ink, the clockwise moment that is generated in guide component 271 by gravity and buoyancy is greater than the counterclockwise moment in FIG. 6, and when one portion of float portion 272 is exposed from the ink, the buoyancy generated in float portion 272 is reduced, and the clockwise moment and the counterclockwise moment are substantially equal. Therefore, after one portion of float portion 272 is exposed from the ink, if the ink level drops further due to a reduction in ink, float portion 272 moves downward on the surface of the ink. When float portion 272 moves downward, guide component 271 rotates using the bent portion of extender portion 273 as its axis of rotation.

Moreover, an opening 274 may be formed along the extender direction of second arm 273*b*. Opening 274 may have a sloped surface 274*a* which contributes to moving slide member 277. Sloped surface 274*a* may be a flat surface which extends in a direction which is sloped with respect to the horizontal direction.

Slide member 277 may comprise a signal blocking end 227*a* and a non-signal blocking end 272*b*, and may be supported, such that it may move along the extender direction at a predetermined height level similar to slide member 77. A pin 278 of slide member 277 may be inserted into opening 274. In present embodiment, when first arm 273*a* is horizontal, pin 278 may contact the lower edge of sloped surface 274*a*.

A blocking portion 279 of slide member 277 may comprise blocking end 227*a* and may be positioned within translucent portion 40 when pin 278 is in contact with the lower edge portion of sloped surface 274*a*, and when pin 278 is in contact with the upper edge portion of sloped surface 274*a*, blocking portion 279 may be positioned outside of translucent portion 40 and within ink chamber 61.

Therefore, in ink cartridge 201, when there is a sufficient amount of ink stored within ink chamber 61, because the clockwise moment generated in guide component 271 is greater than the counterclockwise moment, guide component 71 will receive a force in the clockwise direction. As a result, the space between light emitting portion 1014*a* and light receiving portion 1014*b* will be blocked, and a the control substrate of printer 1000 may determine that there is ink remaining within ink chamber 61.

As the ink level drops according to a reduction in the amount of ink remaining within ink chamber 61, a portion of float portion 272 may be exposed from the ink surface, and the clockwise moment generated in guide component 271 may be about the same as the counterclockwise moment. Then, as the ink surface drops further, float portion 272 may be displaced downwards due to the drop in the ink level, and extender portion 273 may rotate counterclockwise about the bent portion. Therefore, pin 278 may be guided towards away from translucent portion 40 by sloped surface 274*a*, and slide member 277 may slide in opposite direction to that of translucent portion 40. At this time, light may pass between light emitting portion 1014*a* and light receiving portion 1014*b*, such that the control substrate of printer 1000 may determine that there is substantially no ink remaining within ink chamber 61. For example, as the ink level drops according to a reduction in the amount of ink remaining within ink chamber 61, movable member 270 may move, such that a distance between float portion 272 and signal blocking end 277*a* decreases and a distance between float portion 272 and non-signal blocking end 277*b* increases.

While the invention has been described in connection with exemplary embodiments, it will be understood by those skilled in art that other variations and modifications of the exemplary embodiments described above may be made without departing from the scope of invention. Other embodiments will be apparent to those skilled in art from a consideration of the specification or practice of the invention disclosed herein. It is intended that specification and described examples are considered merely as exemplary of invention, with the true scope of the invention being indicated by the flowing claims.

What is claimed is:

1. An ink cartridge, comprising:

an ink chamber comprising a wall having a first end and a second end opposite the first end;

a translucent portion positioned at the wall, wherein the translucent portion is configured to be in fluid communication with the ink chamber, and the translucent portion has an inner space formed therein; and a movable member comprising:

a sliding member comprising a signal blocking portion, wherein the signal blocking portion is configured to move in a first direction from a first position within the inner space of the translucent portion to a second position based on the amount of ink within the ink chamber; and a float portion operationally coupled to the sliding member, wherein the float portion is disposed within the ink chamber and is configured to move in a second direction from a third position to a fourth position based on the amount of ink within the ink chamber, wherein the second direction is slanted with respect to the first direction.

2. The ink cartridge of claim 1, further comprising an ink supply portion having an opening formed therethrough, wherein the ink supply portion is positioned at the wall adjacent to the second end of the wall, and the translucent portion is positioned between the first end of the wall and the ink supply portion.

3. The ink cartridge of claim 1, wherein the second position is outside of the inner space of the translucent portion.

4. The ink cartridge of claim 1, wherein the movable member further comprises an extender portion coupled to each of the sliding member and the float portion, such that the float portion is operationally coupled to the sliding member via the extender portion, wherein the extender portion has a guide path formed therethrough, and the sliding member further comprises a pin member which couples the sliding portion to the extender portion via the guide path.

5. The ink cartridge of claim 4, wherein the guide path comprises a first portion which extends in the second direction, and a second portion which is slanted with respect to the first portion.

6. An ink cartridge, comprising:

an ink chamber comprising a wall having a first end and a second end opposite the first end;

a translucent portion positioned at the wall, wherein the translucent portion is configured to be in fluid communication with the ink chamber, and the translucent portion has an inner space formed therein; and a movable member comprising:

a sliding member comprising a signal blocking portion, wherein the signal blocking portion is configured to move in a first direction from a first position within the inner space of the translucent portion to a second position based on the amount of ink within the ink chamber; and a float portion operationally coupled to the sliding member, wherein the float portion is disposed within the ink chamber and is configured to move in a second direction from a third position to a fourth position based on the amount of ink within the ink chamber, wherein the first direction is non-parallel with respect to the second direction.

7. The ink cartridge of claim 6, wherein the second direction is substantially perpendicular to the first direction.

8. The ink cartridge of claim 6, further comprising an ink supply portion having an opening formed therethrough, wherein the ink supply portion is positioned at the wall adjacent to the second end of the wall, and the translucent portion is positioned between the first end of the wall and the ink supply portion.

9. The ink cartridge of claim 6, wherein the second position is outside of the inner space of the translucent portion.

10. The ink cartridge of claim 6, wherein the movable member further comprises an extender portion coupled to each of the sliding member and the float portion, such that the float portion is operationally coupled to the sliding member via the extender portion, wherein the extender portion has a guide path formed therethrough, and the sliding member further comprises a pin member which couples the sliding portion to the extender portion via the guide path.

11. The ink cartridge of claim 10, wherein the guide path comprises a first portion which extends in the second direction, and a second portion which is slanted with respect to the first portion.

* * * * *